US005695112A

United States Patent [19]

De Valdenebro

[11] Patent Number: 5,695,112

[45] Date of Patent: Dec. 9, 1997

[54] CONTAINER WITH STRING OPENER SPECIFICATION IDENTIFICATION

[76] Inventor: Eladio De Valdenebro, Calle 7 #56-70, Cali, Colombia

[21] Appl. No.: 762,880

[22] Filed: Dec. 12, 1996

[51] Int. Cl.[6] ..... B65D 5/70

[52] U.S. Cl. ..... 229/239; 229/216

[58] Field of Search ..... 229/213, 214, 229/216, 217, 239

[56] References Cited

U.S. PATENT DOCUMENTS

| | | | |
|---|---|---|---|
| 2,074,156 | 3/1937 | Weber | 229/239 |
| 2,305,631 | 12/1942 | Moore | 229/216 |
| 2,421,141 | 5/1947 | Carr | 229/216 |
| 3,797,726 | 3/1974 | Reil | 229/216 |
| 4,027,455 | 6/1977 | Rausing et al. | 229/216 |
| 4,301,927 | 11/1981 | Carlsson et al. | 229/216 |
| 4,450,581 | 5/1984 | Hirata | 229/216 |
| 5,322,214 | 6/1994 | Jonsson et al. | 229/239 |
| 5,601,233 | 2/1997 | Kageyama et al. | 229/216 |

*Primary Examiner*—Gary E. Elkins
*Attorney, Agent, or Firm*—J. Sanchelima

[57] ABSTRACT

An improved cardboard container of the type that includes spout surfaces joined together at their upper edges defining a sealed band. A cutting string is attached to the sealed band at a predetermined position at the beginning of a pre-weakened path that the string, when pulled by a user, will cut. In this manner a spout opening is made through which the container's contents are poured out.

6 Claims, 2 Drawing Sheets

CONTAINER WITH STRING OPENER SPECIFICATION IDENTIFICATION

BACKGROUND OF THE INVENTION

1. Field of the Invention

The present invention relates to cardboard containers, and more particularly, to the type that includes spout surfaces that are cut to make an opening to pour the contents out.

2. Description of the Related Art

There are many devices that aid a user to open cardboard containers of the type that includes spout surfaces that require to be cut. However, none of them discloses the features of the present invention. None of the existing container openers is attached to a container and include a string mounted to the container permitting a user to manipulate it and cause an aperture to be made through which the contents can be poured out.

Multilayer containers where the present invention can be implemented include those marketed under the label of Tetra Pak, Tetra Classic, Tetra Bric Aseptic and Tetra Lawal, among others. Typically, layers of papers, polyethylene and aluminum composed the walls of these containers and it is difficult to cut a section without a knife or scissors. The present invention provides an inexpensive and simply device for accomplishing this without compromising the airtightness of the sealed container. By marking (weakening) a predetermined path, a user will make an aperture of cooperative dimensions to permit the contents (liquid or powder) to be poured out.

SUMMARY OF THE INVENTION

It is one of the main objects of the present invention to provide a container with a string opener that is readily attached to the container.

It is another object of this invention to provide a container with a string opener that permits a user to easily make an aperture or outlet to the container through which its contents may be poured out.

It is yet another object of this invention to provide such a container opener that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
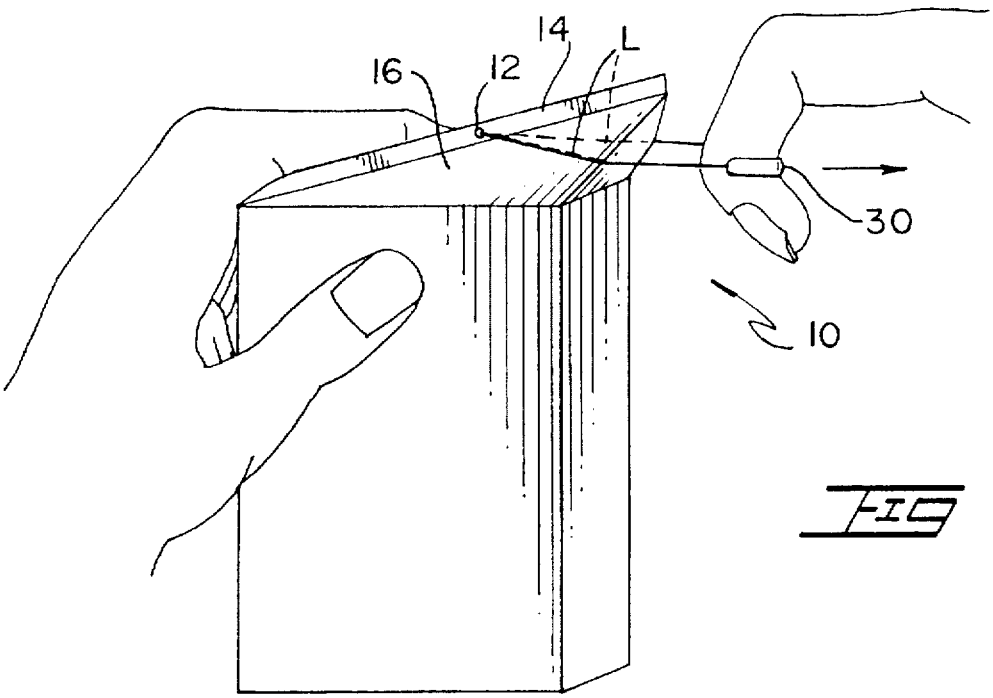
FIG. 1 is an isometric view of a container with the present invention mounted thereon showing a user pulling the container opener string.

Referring now to the drawings, where the present invention is generally referred to with numeral 10, it can be observed that it basically includes string 20 mounted to the uppermost portion of a container and actuating pad 30 for a user to manipulate string 20. When string 20 is pulled, an aperture is made along a predetermined path. This aperture allows a user to pour out the contents of the container.

Container 10, in the preferred embodiment shown in FIG. 1, includes string 20 that can be made out of a resistant plastic, nylon, steel material, or equivalent material with cutting properties. Container 10 includes string 20 inserted through opening 12 previously made in sealed band 14 on the uppermost portion of container 10. A user pulls string 20 through pad 30 and the former, travels through non-continuous weakening lines L predisposed along spout surfaces 16 of container 10. The present invention was designed to overcome the inconvenience of manually opening a container or, in many cases, requiring the use of a cutting tool.

Figure 2:
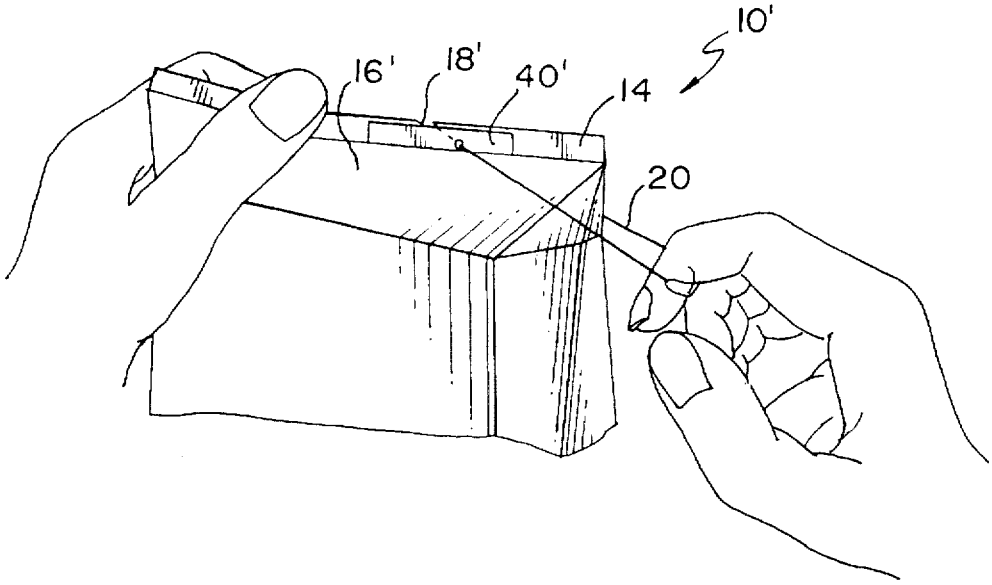
FIG. 2 is a partial isometric view of an alternate embodiment of this invention with a cutout wherein a portion of the string is held.
Figure 3:
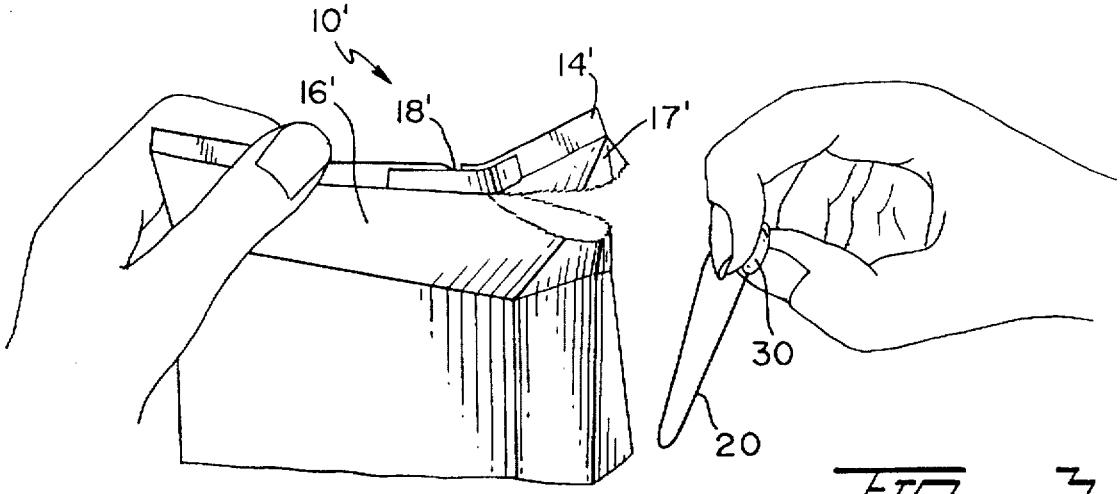
FIG. 3 illustrates a user pulling the string causing an aperture to be made.

In FIGS. 2 and 3 an alternate embodiment is shown for container 10'. Cutout 18' is provided at a predetermined location on the edge of sealed band 14'. Bands 40' (the second one is not shown) are affixed to the sides of band 14' keeping string 20 within cutout 18' in sealed band 14' on the uppermost portion of container 10'. Bands 40' are made out of an adhesive material that keeps portion 17' of spout surfaces 16' within cutout 18'.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. In a cardboard container that includes two spout surfaces joined at a common uppermost edge defining a sealed band, the improvement comprising string means for cutting said spout surfaces mounted to said sealed band along a predetermined weakened path on said spout surfaces so that when said string means is pulled by a user an opening is made by causing said string means to cut along said path and said container's contents may be poured out through said opening.

2. The improvement set forth in claim 1 wherein said string means further includes a pad member so that a user may exert the necessary force through said pad member without cutting his or her fingers.

3. The improvement set forth in claim 2 wherein said sealed band includes an opening through which said string means is inserted.

4. The improvement set forth in claim 3 wherein said sealed band includes a cutout at a predetermined cooperative position to correspond with said predetermined weakened path.

5. The improvement set forth in claim 4 further including means for holding said string means in place.

6. The improvement set forth in claim 5 wherein said means for holding said string means in place includes at least one adhesive band attached to said sealed band keeping a portion of said string means within said cutout.

* * * * *